US011550254B2

(12) United States Patent
Niikawa

(10) Patent No.: US 11,550,254 B2
(45) Date of Patent: Jan. 10, 2023

(54) IMAGE FORMING APPARATUS

(71) Applicant: CANON KABUSHIKI KAISHA, Tokyo (JP)

(72) Inventor: Yusuke Niikawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/514,237

(22) Filed: Oct. 29, 2021

(65) Prior Publication Data

US 2022/0146978 A1 May 12, 2022

(30) Foreign Application Priority Data

Nov. 9, 2020 (JP) ..... JP2020-186758

(51) Int. Cl.
*G03G 15/00* (2006.01)

(52) U.S. Cl.
CPC ..... *G03G 15/757* (2013.01)

(58) Field of Classification Search
CPC ..... G03G 15/757
See application file for complete search history.

(56) References Cited

U.S. PATENT DOCUMENTS 8,503,910 B2 * 8/2013 Matsuda ..... G03G 15/5008 399/167
9,217,982 B2 * 12/2015 Hashimoto ..... G03G 15/5008
11,175,620 B2 11/2021 Niikawa
2007/0031166 A1 * 2/2007 Zensai ..... G03G 15/757 399/167
2008/0143813 A1 * 6/2008 Lee ..... G03G 15/757 347/248
2010/0278560 A1 * 11/2010 Ino ..... G03G 15/0194 399/167
2014/0169830 A1 * 6/2014 Ino ..... G03G 15/0131 399/167

FOREIGN PATENT DOCUMENTS

JP 2010-140060 A 6/2010

* cited by examiner

*Primary Examiner* — Sevan A Aydin
(74) *Attorney, Agent, or Firm* — Venable LLP

(57) ABSTRACT

An image forming apparatus includes a photosensitive member; a charging member, an exposure member, a developing member, a transfer member, a moving member, a motor, a first drive transmitting portion, and a second drive transmitting portion. A rotation amount of the motor when the photosensitive member rotates from an exposure position to a transfer position during image formation is $2\pi n+\eta$ [rad] where n is a natural number, and $\eta$ is an increased rotation amount [rad] of the motor. The following relationship is satisfied: $0<\eta<\pi-\Phi$ where $\Phi$ is an angle [rad] which is formed by a line connecting rotation centers of a first gear of the motor and a second gear of the first driving transmitting portion and a line connecting rotation centers of the first gear of the motor and a third gear of the second driving transmitting portion.

10 Claims, 7 Drawing Sheets

(a)

(b)

(a)

(b)

IMAGE FORMING APPARATUS

FIELD OF THE INVENTION AND RELATED ART

The present invention relates to an image forming apparatus such as an electrophotographic copying machine or an electrophotographic printer (for example, a laser beam printer or an LED printer).

In the image forming apparatus of an electrophotographic type, an electrostatic latent image is formed on a surface of a photosensitive member by an exposure process and is developed by a developing process, and then a developer image obtained by developing the electrostatic latent image is subjected to a transfer process in which the developer image is transferred onto a developing image receiving member, i.e., a sheet or an intermediary transfer member, so that an image is formed. Incidentally, the developer image transferred on the intermediary transfer member is finally transferred onto the sheet.

Here, in Japanese Laid-Open Patent Application (JP-A) 2010-140060, in a constitution in which a driving force of a motor is transmitted to the photosensitive member and the photosensitive member is rotationally driven, a constitution in which the influence of rotation non-uniformity of the motor on the image formed on the sheet is suppressed is disclosed. In the constitution of JP-A 2010-140060, in the case where with respect to a rotational direction of the photosensitive member, a position where the exposure process is carried out is an exposure position and a position where the transfer process is carried out is a transfer position, the motor is rotated an integral number of times when the photosensitive member rotates from the exposure position to the transfer position. By such a constitution, even when the motor causes the rotation non-uniformity, a phase of the motor is the same between the exposure position and the transfer position, and therefore, the influence of the rotation non-uniformity is cancelled, so that the influence of the rotation non-uniformity of the motor on the image formed on the sheet is suppressed.

In the constitution of JP-A 2010-140060, by a single motor, both a photosensitive drum and a feeding belt for feeding the sheet which is a developing image receiving member are driven. Here, as described above, the influence of the rotation non-uniformity of the motor in the photosensitive member is suppressed between the exposure position and the transfer position. However, the influence of the rotation non-uniformity of the motor in the feeding belt is not suppressed by the above-described control, and there is a liability that the rotation non-uniformity of the motor has an adverse influence on the image.

SUMMARY OF THE INVENTION

A principal object of the present invention is to provide an image forming apparatus capable of suppressing an adverse influence on an image caused due to rotation non-uniformity of a single motor in a constitution in which a moving motor for moving a photosensitive member and a developing image receiving member is driven by the single motor.

According to an aspect of the present invention, there is provided an image forming apparatus comprising: a photosensitive member; a charging member configured to electrically charge the photosensitive member; an exposure member configured to form an electrostatic latent image by irradiating a surface of the photosensitive member with light; a developing member configured to form a developer image by supplying a developer to the electrostatic latent image; a transfer member configured to transfer the developer image onto a developer image receiving member; a moving member configured to move the developer image receiving member when the developer image is transferred from the photosensitive member onto the developer image receiving member; a motor including a shaft provided with a first gear; a first drive transmitting portion configured to transmit a driving force of the motor to the photosensitive member and including a second gear engaging with the first gear; and a second drive transmitting portion configured to transmit the driving force of the motor to the moving member and including a third gear engaging with the first gear, wherein in a case that a position where the photosensitive member is irradiated with the light by the exposure member with respect to a rotational direction of the photosensitive member is an exposure position, a position where the developer image is transferred onto the developer image receiving member by the transfer member with respect to the rotational direction is a transfer position, and an angle formed by a line connecting a rotation center of the first gear and a rotation center of the second gear and a line connecting the rotation center of the first gear and a rotation center of the third gear is $\Phi$ [rad] in which a direction opposite to a rotational direction of the first gear during image formation is a positive direction of 1, a rotation amount of the motor when the photosensitive member rotates from the exposure position to the transfer position during the image formation is: $2\pi n+\eta$ [rad], where n is a natural number, and $\eta$ is an increased rotation amount [rad] of the motor, and wherein the following relationship is satisfied: $0<\eta<\pi-\Phi$.

According to another aspect of the present invention, there is provided an image forming apparatus comprising: a photosensitive member; a charging member configured to electrically charge the photosensitive member; an exposure member configured to form an electrostatic latent image by irradiating a surface of the photosensitive member with light; a developing member configured to form a developer image by supplying a developer to the electrostatic latent image; a transfer member configured to transfer the developer image onto a developer image receiving member; a moving member configured to move the developer image receiving member when the developer image is transferred from the photosensitive member onto the developer image receiving member; a motor including a shaft provided with a first gear; a first drive transmitting portion configured to transmit a driving force of the motor to the photosensitive member and including a second gear engaging with the first gear; and a second drive transmitting portion configured to transmit the driving force of the motor to the moving member and including a third gear engaging with the first gear, wherein in a case that a position where the photosensitive member is irradiated with the light by the exposure member with respect to a rotational direction of the photosensitive member is an exposure position, a position where the developer image is transferred onto the developer image receiving member by the transfer member with respect to the rotational direction is a transfer position, and an angle formed by a line connecting a rotation center of the first gear and a rotation center of the second gear and a line connecting the rotation center of the first gear and a rotation center of the third gear is $\Phi$ [rad] in which a direction opposite to a rotational direction of the first gear during image formation is a positive direction of $\Phi$, a rotation amount of the motor when the photosensitive member rotates from the exposure position to the transfer position during the image formation is: $2\pi n+\eta$ [rad], where n is a natural number, and $\eta$ is an increased rotation amount [rad] of the motor, and wherein the following relationship is satisfied: $\pi-\Phi<\eta<0$.

Further features of the present invention will become apparent from the following description of exemplary embodiments with reference to the attached drawings.

BRIEF DESCRIPTION OF THE DRAWINGS

Parts (a) and (b) of FIG. 1 are schematic sectional views of an image forming apparatus.

Figure 3:
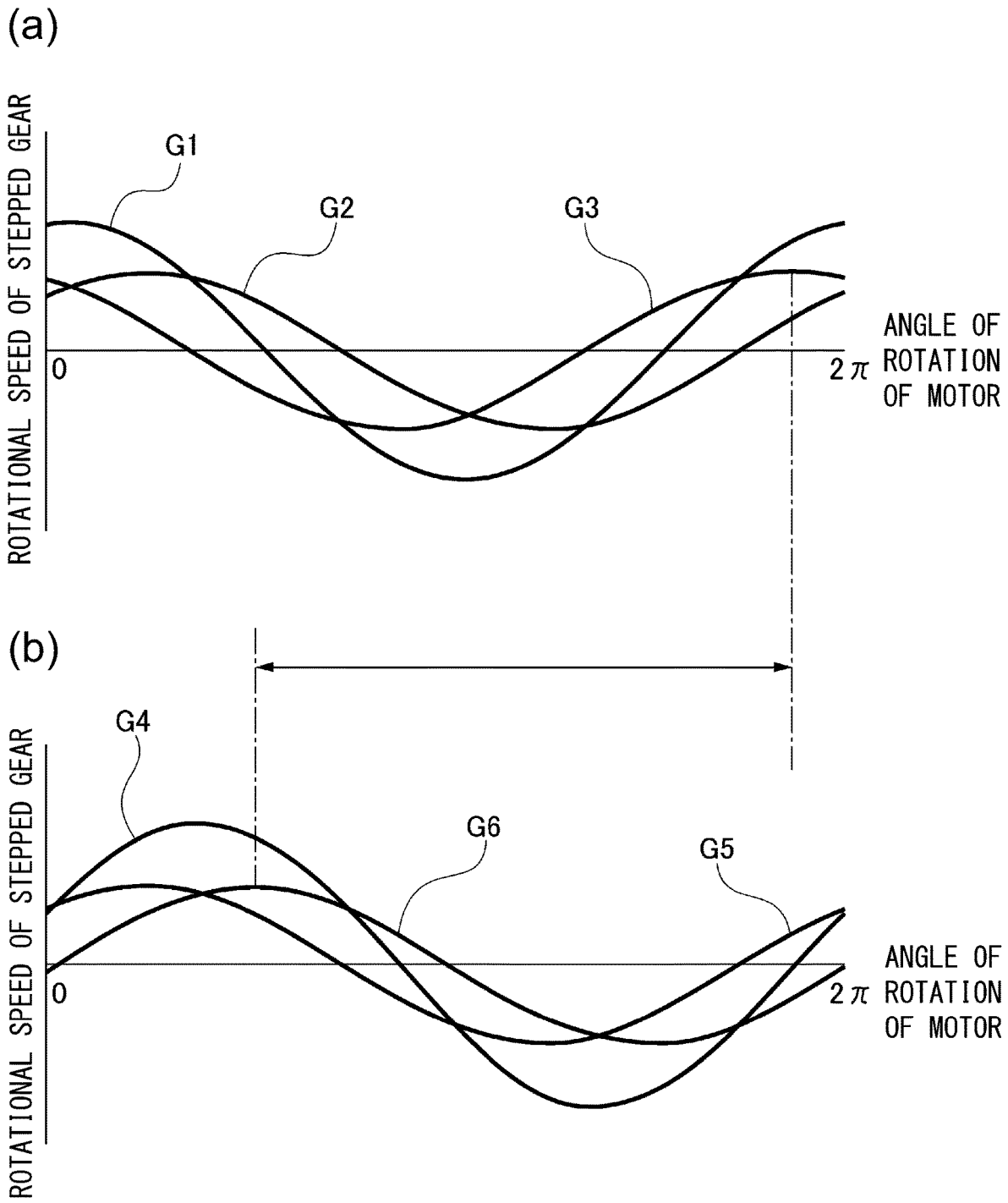

Parts (a) and (b) of FIG. 3 are graphs each showing an example of a profile of a rotational speed of a stepped gear.

Figure 4:
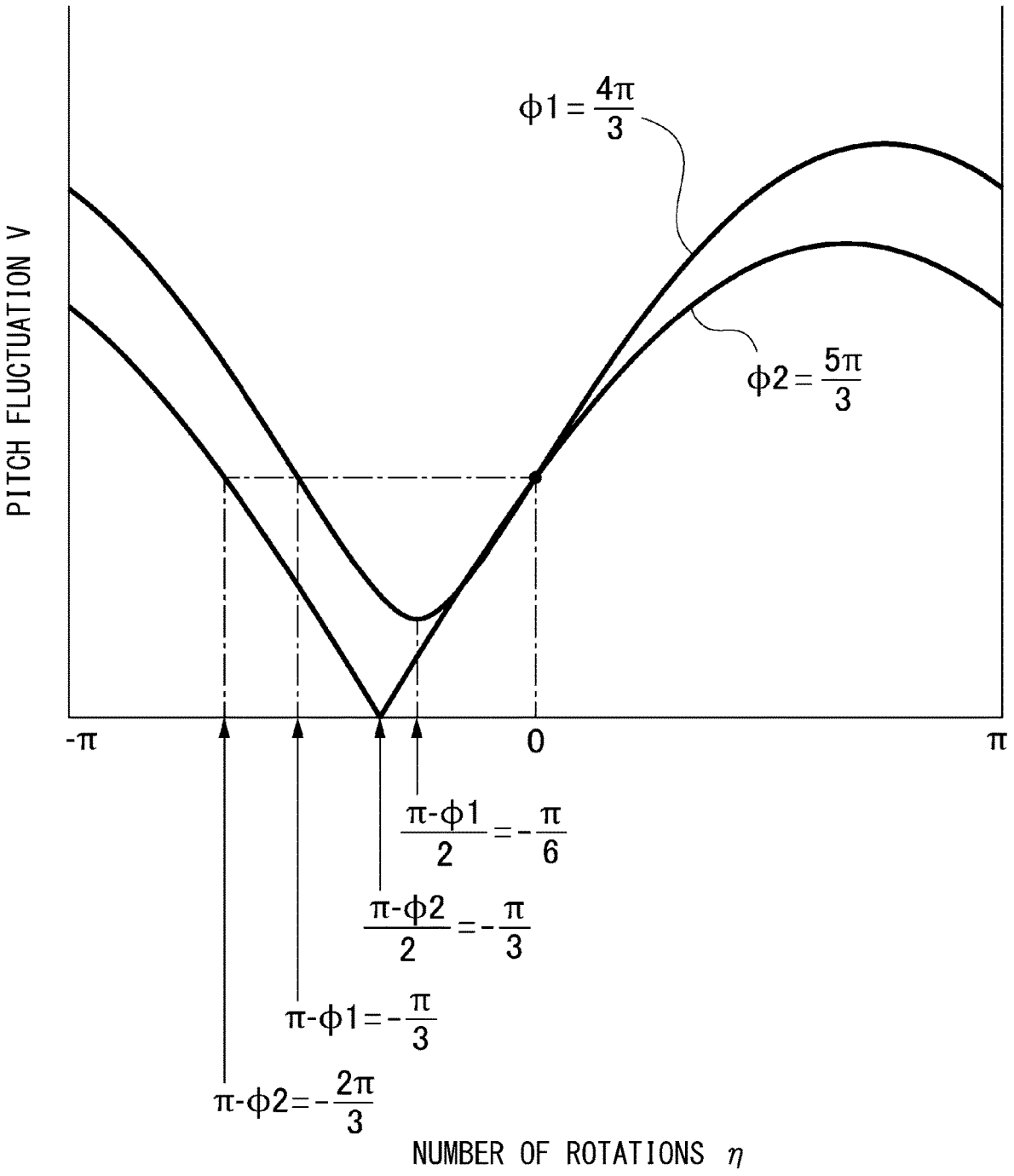

FIG. 4 is a graph showing a relationship between an engaging phase difference, a rotation amount of a motor, and a pitch fluctuation.

Figure 5:
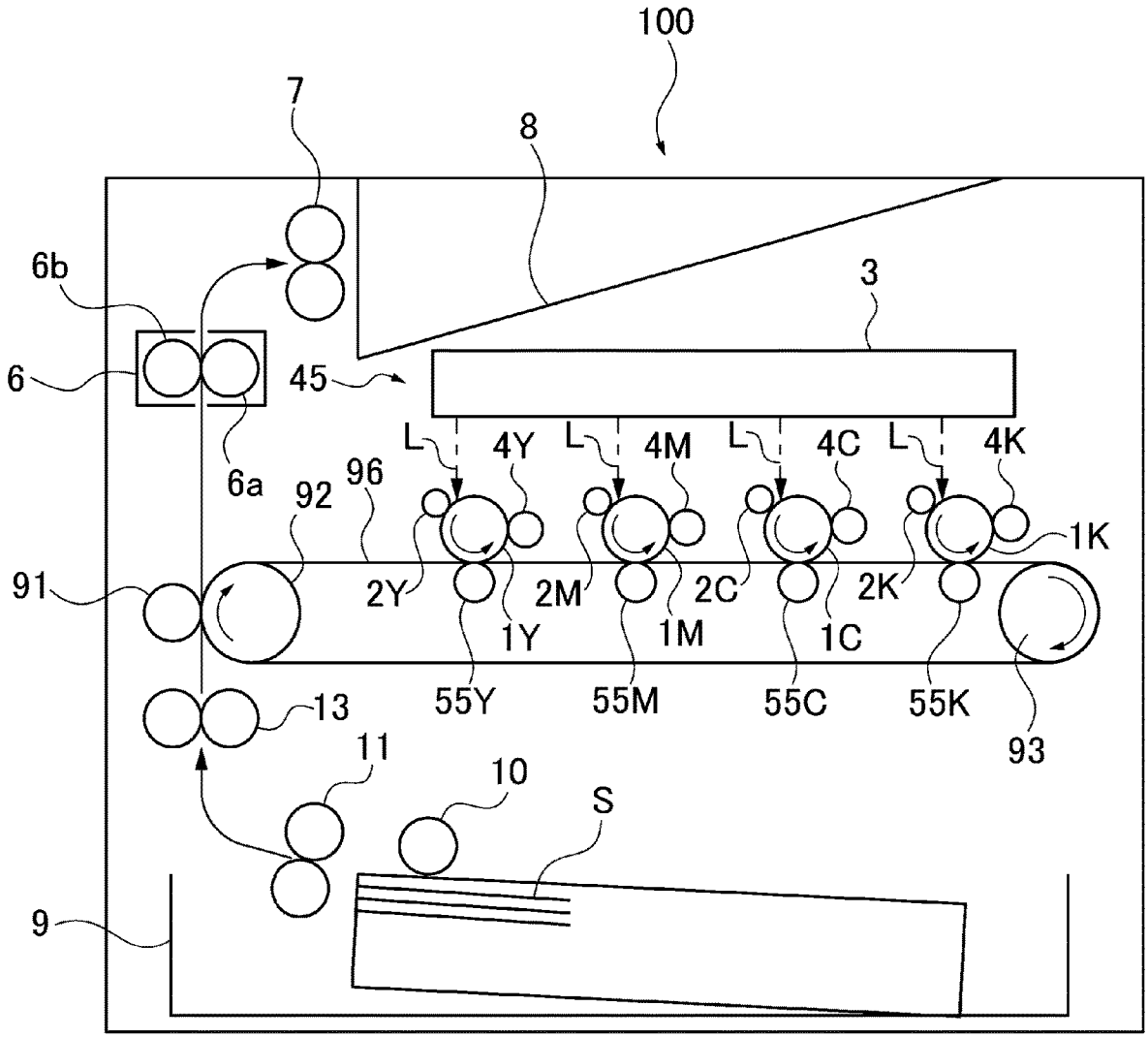

FIG. 5 is a schematic sectional view of an image forming apparatus.

Figure 6:
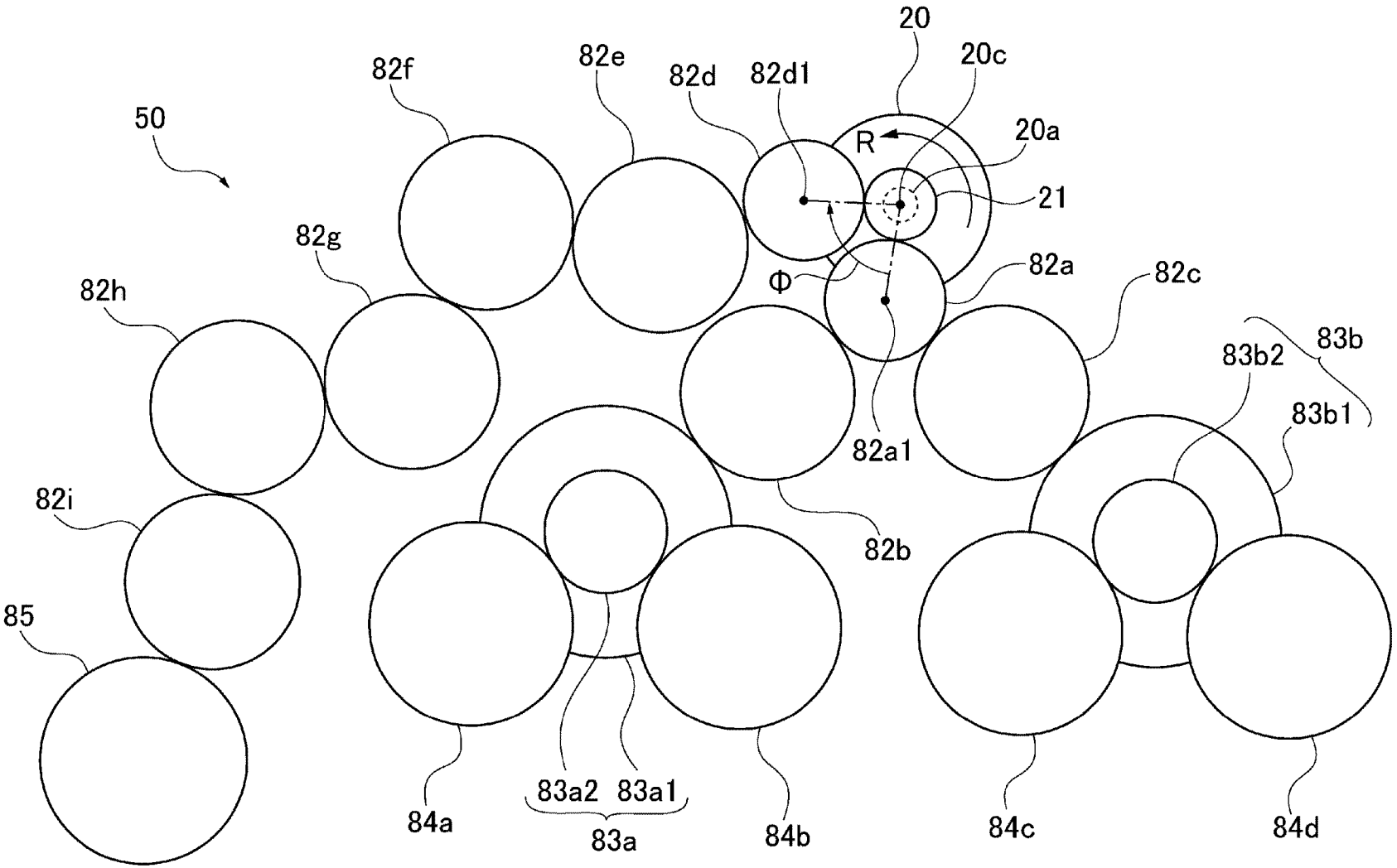

FIG. 6 is a schematic view of a driving unit.

Figure 7:
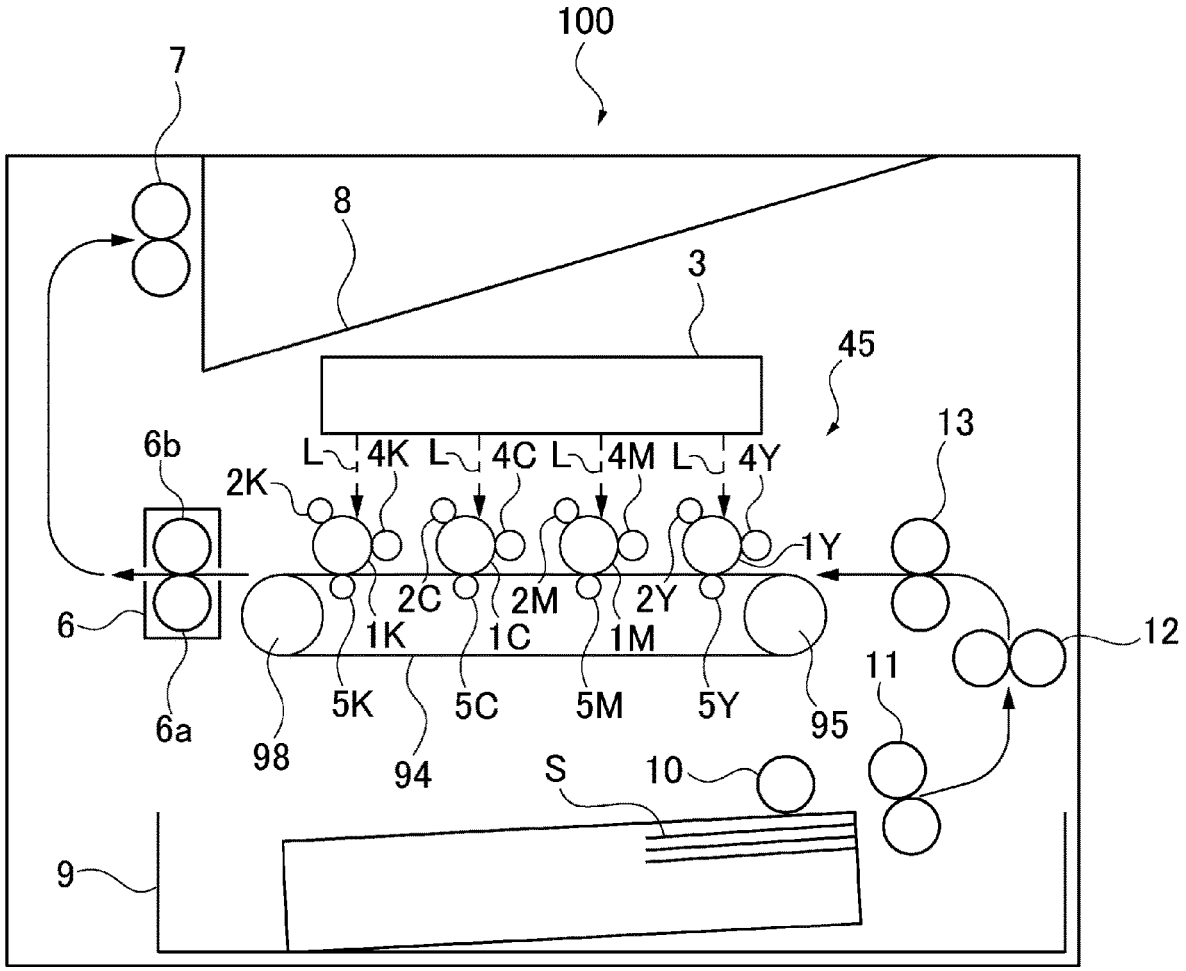

FIG. 7 is a schematic sectional view of an image forming apparatus.

DESCRIPTION OF THE EMBODIMENTS

First Embodiment

<Image Forming Apparatus>

In the following, first, a general structure of an image forming apparatus according to a first embodiment of the present invention will be specifically described together with an operation during image formation while making reference to the drawings. Incidentally, as regards dimensions, material, shapes and relative arrangement, and the like of constituent elements described in the following, the scope of the present invention is not intended to be limited thereto, unless otherwise specified.

Figure 1:
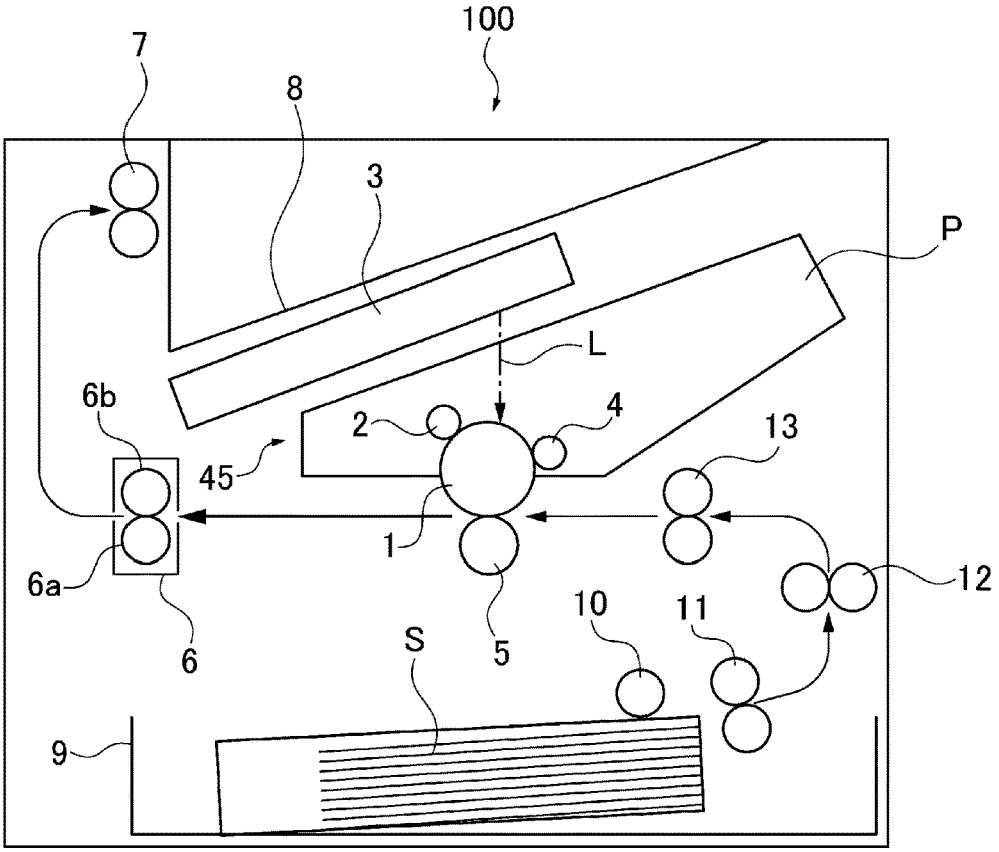
Figure 1:
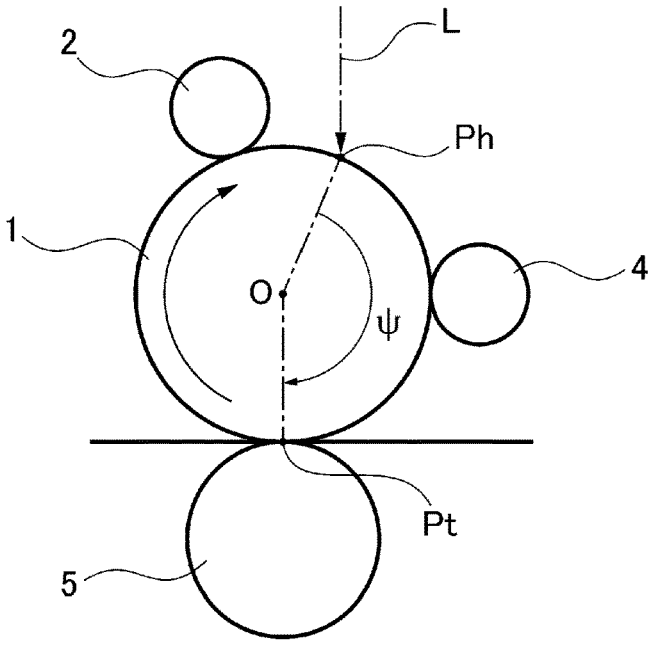

Part (a) of FIG. 1 is a schematic sectional view of an image forming apparatus 100. Part (b) of FIG. 1 is an enlarged view of a photosensitive drum 1 and a periphery thereof in part (a) of FIG. 1. As shown in part (a) of FIG. 1, the image forming apparatus 100 includes an image forming portion 45. The image forming portion 45 includes a process cartridge P constituted so as to be mountable in and dismountable from the image forming apparatus 100, and includes a laser scanner unit 3 (exposure member) and a transfer roller 5 (transfer member). The process cartridge P further includes the photosensitive drum 1 (photosensitive member), a charging roller 2 (charging member), and a developing roller 4 (developing member).

In the case where an image is formed by the image forming apparatus 100, first, when an unshown controller receives an image forming job signal, a sheet S stacked and accommodated in a sheet cassette 9 is fed to a registration roller pair 13 by a pick-up roller 10, a feeding roller pair 11, and a conveying roller pair 12. Thereafter, the registration roller pair 13 feeds the sheet S, at a predetermined timing, to a transfer nip formed by the photosensitive drum 1 and the transfer roller 5.

On the other hand, in the image forming portion 45, first, the surface of the photosensitive drum 1 is electrically charged by the charging roller 2. Thereafter, the laser scanner unit 3 performs an exposure process in which the surface of the photosensitive drum 1 is irradiated with laser light L depending on image data inputted from an unshown external device. By this, on the surface of the photosensitive drum 1, an electrostatic latent image depending on the image data is formed.

Next, the developing roller 4 supplies toner, carried on a surface of the developing roller 4, to the electrostatic latent image formed on the surface of the photosensitive drum 1, and forms a toner image (developer image) on the surface of the photosensitive drum 1. Thereafter, the toner image formed on the surface of the photosensitive drum 1 is transferred onto a sheet S (developing image receiving member) by applying a bias to the transfer roller 5.

Then, the sheet S on which the toner image is formed is fed to a fixing device 6. Then, the sheet S is subjected to a heating and pressing process in a fixing nip portion formed by a pressing roller 6*a* and a heating roller 6*b* which are included in the fixing device 6, whereby the toner image on the sheet S is fixed on the sheet S. The pressing roller 6*a* feeds the sheet S by rotation. Further, the heating roller 6*b* includes a heat source therein and is rotated in contact with the pressing roller 6. Therefore, the sheet S on which the toner image is fixed is discharged to a discharge portion 8 by a discharging roller pair 7.

Here, as regards a position of the photosensitive drum 1 with respect to a rotational direction, a position where the photosensitive drum surface is irradiated with the laser light L from the laser scanner unit 3 which is an exposure member is defined as an exposure position Ph. Further, as regards the position of the photosensitive drum 1 with respect to the rotational direction, a position where the toner image is transferred onto the developing image receiving member by the transfer member, i.e., a position where in this embodiment, the toner image is transferred onto the sheet S which is the developer image (toner image) receiving member by the transfer roller 5 which is the transfer member, is defined as a transfer position Pt. At this time, an angle of rotation $\Psi$ from the exposure position Ph to the transfer position Pt with respect to the rotational direction of the photosensitive drum 1 during image formation is set at 0.889 $\pi$ [rad] (160 degrees) in this embodiment. Incidentally, the angle of rotation $\Psi$ can also be said as an angle formed by a rectilinear line connecting the exposure position Ph and a rotation center O of the photosensitive drum 1 and a rectilinear line connecting the transfer position Pt and the rotation center O of the photosensitive drum 1.

Further, when the toner image is transferred from the photosensitive drum 1 onto the sheet S by the transfer roller 5, the sheet S is fed by the registration roller pair 13 and the pressing roller 6*a* of the fixing device 6. That is, the registration roller pair 13 and the pressing roller 6*a* constitute a moving member for moving the sheet S when the toner image is transferred from the photosensitive drum 1 onto the sheet S which is the developing image receiving member. Further, a feeding speed of the sheet S is determined by the registration roller pair 13 and the pressing roller 6*a*.

<Driving Unit>

Next, a structure of a driving unit 40 for driving the respective members of the image forming apparatus 100 will be described. In this embodiment, the driving unit 40 drives the photosensitive drum 1, the fixing device 6, the pick-up roller 10, the feeding roller pair 11, a conveying roller pair 12, the registration roller pair 13, and the discharging roller pair 7 by a single motor 20.

Figure 2:
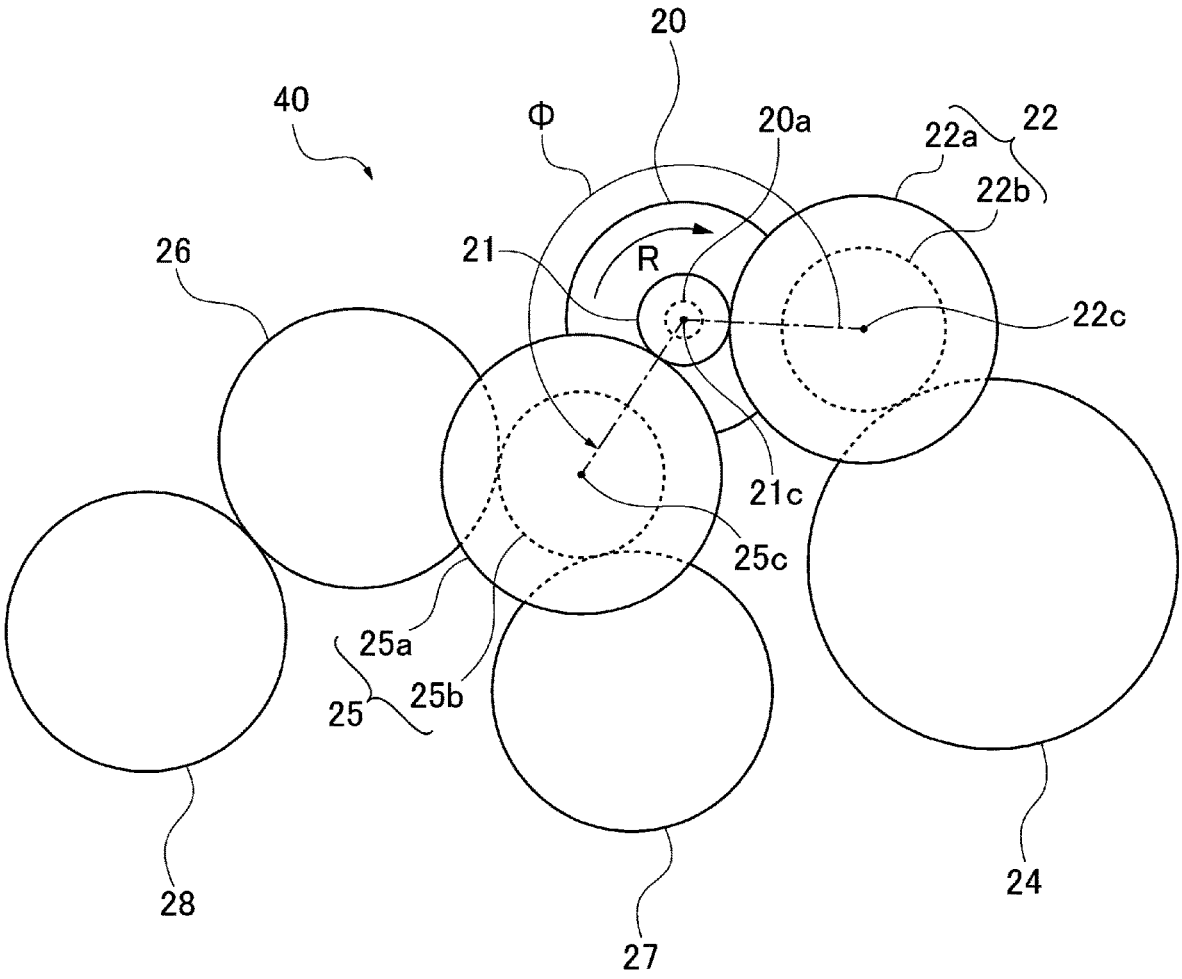
FIG. 2 is a schematic view of a driving unit.

FIG. 2 is a schematic view of the driving unit 40. As shown in FIG. 2, the driving unit 40 includes, as a gear train (first driving transmitting portion) for driving the photosensitive drum 1, a pinion gear 21 (first gear) mounted on a shaft 20*a* of a motor 20, a stepped gear 22 (second gear), and a drum driving gear 24.

The stepped gear 22 includes a large gear portion 22*a* engaging with the pinion gear 21 and a small gear portion 22*b* engaging with the drum driving gear 24. The drum driving gear 24 is a gear mounted integrally with the photosensitive drum 1. When the motor 20 is driven, the pinion gear 21 is rotated, so that a pinion gear force is transmitted to the drum driving gear 24 via the stepped gear 22. By this, the photosensitive drum 1 is rotated integrally with the drum driving gear 24.

Here, in this embodiment, the number of teeth of the driving is set at 13 teeth, the number of teeth of the large gear portion 22*a* of the stepped gear 22 is set at 63 teeth, the number of teeth of the small gear portion 22*b* of the stepped gear 22 is set at 39 teeth, and the number of teeth of the drum driving gear 24 is set at 89 teeth. From a relationship of these numbers of teeth, a (speed) reduction ratio of a gear train from the motor 20 to the photosensitive drum 1 is 0.0904 $(=(13/63)\times(39/89))$.

Further, the driving unit 40 includes the pinion gear 21, a stepped gear 25, idler gears 26 and 27, a pressing roller gear 28, and the like as a gear train (second driving transmitting portion) for driving the pick-up roller 10, the feeding roller pair 11, the conveying roller pair 12, the registration roller pair 13, the fixing device 6, and the discharging roller pair 7.

The stepped gear 25 (third gear) includes a large gear portion 25*a* engaging with the pinion gear 21 and a small gear portion 25*b* engaging with each of the idler gears 27 and 28. The pressing roller gear 28 is a gear engaging with the idler gear 26 and mounted integrally with the pressing roller 6*a*. Further, an unshown gear train branching from the idler gear 26 or 27 is further provided, and via the unshown gear train, the driving force is transmitted to the pick-up roller 10, the feeding roller pair 11, the conveying roller pair 12, the registration roller pair 13, and the discharging roller pair 7.

When the motor 20 is driven, the pinion gear 21 is rotated, and the driving force is transmitted to the pressing roller gear 28 via the stepped gear 22 and the idler gear 26. By this, the pressing roller 6*a* integrally rotates the pressing roller gear 28. Further, when the motor 20 is driven, the pinion gear 21 is rotated, and the driving force is transmitted to the pick-up roller 10, the feeding roller pair 11, the conveying roller pair 12, the registration roller pair 13, and the discharging roller pair 7 via the stepped gear 22, the idler gears 26 and 27, and the unshown gear train.

Here, the large gear portion 25*a* of the stepped gear 25 is the same as the large gear portion 22*a* of the stepped gear 22 in number of teeth and module, and engages with the pinion gear 21 at the substantially same position with respect to the thrust direction. The substantially same position referred to in this embodiment includes the case where the positions of the large gear portions 22*a* and 25*a* with respect to the thrust direction are completely the same and the case where the positions of the large gear portions 22*a* and 25*a* with respect to the thrust direction are deviated in a tolerance range.

Further, an angle formed by a rectilinear line connecting a rotation center of a gear which is a gear engaging with the pinion gear 21 and which is included in the gear train to which the driving force of the motor 20 is transmitted to the photosensitive drum 1 and connecting the rotation center 21*a* of the pinion gear 21 and by a rectilinear line connecting a rotation center of a gear which is a gear engaging with the pinion gear 21 and which is included in the gear train to which the driving force of the motor 20 is transmitted to the moving motor for moving the developing image receiving member onto which the toner (developer) image is transferred from the photosensitive drum 1 is transferred, is referred to as an engaging phase difference Φ. In this embodiment, an angle formed by a rectilinear line connecting the rotation center 22*c* of the stepped gear 22 and the rotation center 21*c* of the pinion gear 21 and a rectilinear line connecting the rotation center 25*c* of the stepped gear 25 and the rotation center 21*c* of the pinion gear 21 is the engaging phase difference Φ, and $\Phi=4\pi/3$ [rad] (240 degrees) is set. A positive direction of the engaging phase difference Φ is a direction opposite to the arrow roller direction which is a rotational direction of the pinion gear 21 during image formation.

<Influence of Rotation Non-Uniformity of Motor>

Next, an influence, on the image on the sheet S, caused due to rotation non-uniformity of the motor 20 will be described. Here, the rotation non-uniformity of the motor 20 is a speed fluctuation of the motor 20 during rotation of one-full circumference, and occurs due to rotation non-uniformity of the motor itself resulting from eccentricity or the like of bearings in the motor 20, run-out of the shaft 20*a* of the motor 20, eccentricity of the pinion gear 21, and the like.

Part (a) of FIG. 3 is a graph showing an example of a profile of a rotational speed Vd of the stepped gear 22 included in the gear train for driving the photosensitive drum 1 during rotation of one-full circumference of the motor 20. In part (a) of FIG. 3, a curve G1 shows a wave form of a rotational speed fluctuation of the stepped gear 22 due to rotation non-uniformity of the motor 20 itself, a curve G2 shows a wave form of a speed fluctuation of the stepped gear 22 due to the rotation non-uniformity of the motor 20 itself, and a curve G3 shows a wave form of a speed fluctuation of the stepped gear 22 due to the run-out of the shaft 20*a* of the motor 20 and the eccentricity of the pinion gear 21.

As shown in part (a) of FIG. 3, the wave form of the rotational speed fluctuation of the stepped gear 22 due to the rotation non-uniformity of the motor 20 is a combined wave form of the wave form of the speed fluctuation of the stepped gear 22 due to the rotation fluctuation of the motor 20 itself and the speed fluctuation of the stepped gear 22 due to the run-out of the motor 20 and the eccentricity of the pinion gear 21. Incidentally, phases of these sine waves change due to manufacturing variations of the motor 20 and the pinion gear 21, a mounting phase of the pinion gear 21 relative to the shaft 20*a* of the motor 20, and the like.

Therefore, a fluctuation of the rotational speed of the stepped gear 22 due to the rotation non-uniformity of the motor 20 is represented by the following formula 1 as a function of a time t. In the formula 1, A is an amplitude of the rotation non-uniformity of the motor 20 itself, B is an amplitude of the run-out of the shaft 20*a* of the motor 20 and the eccentricity of the pinion gear 21, ω is an angular speed of the motor 20, and θ is a phase difference between the run-out of the shaft 20*a* relative to the rotation non-uniformity of the motor 20 itself and the eccentricity of the pinion gear 21.

$$Vd(t)=A\sin\omega t+B\sin(\omega t+\theta) \quad \text{(formula 1)}$$

Part (a) of FIG. 3 is a graph showing an example of a profile of a rotational speed Vd of the stepped gear 25 included in the gear train for driving the registration roller pair 13 and the pressing roller 6*a* which feed the sheet S during rotation of one-full circumference of the motor 20. In part (b) of FIG. 3, a curve G4 shows a wave form of a rotational speed fluctuation of the stepped gear 25 due to rotation non-uniformity of the motor 20 itself, a curve G5 shows a wave form of a speed fluctuation of the stepped gear 25 due to the rotation non-uniformity of the motor 20 itself, and a curve G6 shows a wave form of a speed fluctuation of the stepped gear 25 due to the run-out of the shaft 20*a* of the motor 20 and the eccentricity of the pinion gear 21.

As shown in part (b) of FIG. 3, the phase of the wave form of the speed flow due to rotation non-uniformity of the motor 20 itself in the stepped gear 25 is the same as the phase of the wave form shown in part (a) of FIG. 3. On the other hand, each of between the pinion gear 21 and the stepped gear 22 and between the pinion gear 21 and the stepped gear 25, there is an engaging phase difference Φ, and therefore, the phase of the wave form of the speed fluctuation in the stepped gear 25 due to the run-out of the shaft 20*a* of the motor 20 and the eccentricity of the pinion gear 21 is deviated from the phase of an associated wave form of the stepped gear 22 by the engaging phase difference Φ. A fluctuation in rotational speed Vh of the stepped gear 25 due to the rotation non-uniformity of the motor 20 is represented by the following formula 2 as a function of a time t.

$$Vh(t)=A\sin\omega t+B\sin(\omega t+\theta+\Phi) \quad \text{(formula 2)}$$

Next, a mechanism of an occurrence of the influence on the image on the sheet S by the rotation non-uniformity of the motor 20 will be described. First, when the electrostatic latent image is formed at the exposure position Ph by the laser scanner unit 3, the rotational speed of the photosensitive drum 1 at the exposure position Ph fluctuates depending on the rotational speed fluctuation of the stepped gear 22 due to the rotation non-uniformity of the motor 20, and therefore, a pitch of the electrostatic latent image fluctuates. Specifically, when the rotational speed of the stepped gear 22 increases, the pitch of the electrostatic latent image increases, and when the rotational speed of the stepped gear 22 decreases, the pitch of the electrostatic latent image decreases. In the case where a time of exposure of the photosensitive drum 1 is ta, a pitch fluctuation of this electrostatic latent image is represented by Vd(ta).

Further, when the toner image is transferred onto the sheet S at the transfer position Pt, the rotational speed of the photosensitive drum 1 at the transfer position Pt fluctuates depending on the rotational speed fluctuation of the stepped gear 22 due to the rotation non-uniformity of the motor 20. Specifically, when the rotational speed of the stepped gear 22 increases, a pitch of the toner image decreases, and when the rotational speed of the stepped gear 22 decreases, the pitch of the toner image increases. In the case where a time of transfer of the toner image is tb, a pitch fluctuation of this toner image is represented by −Vd(tb).

Further, when the toner image is transferred onto the sheet S at the transfer position Pt, a movement speed of the sheet S fluctuates depending on the rotational speed fluctuation of the stepped gear 25 due to the rotation non-uniformity of the motor 20. Specifically, when the rotational speed of the stepped gear 25 increases, a pitch of the toner image decreases, and when the rotational speed of the stepped gear 22 decreases, the pitch of the toner image increases. This pitch fluctuation of this toner image is represented by Vh(tb).

A pitch fluctuation V of the image of the sheet S, as the developing image receiving member onto which the toner image (developer image) is transferred from the photosensitive drum 1, caused by the sum of the above-described three pitch fluctuations is represented by the following formula 3. In this embodiment, the influence on the image formed on the sheet S due to the rotation non-uniformity of the motor 20 as described above is reduced by a constitution described below.

$$V=Vd(ta)-Vd(tb)+Vh(tb) \quad \text{(formula 3)}$$

First, a rotation amount of the motor 20 when the photosensitive drum 1 rotates from the exposure position Ph to the transfer position Pt during image formation is represented by 2πn+η [rad] where n is a natural number, and η is an increased rotation amount [rad] relative to an integral (integer) rotation amount of the motor 20 when the photosensitive drum 1 rotates from the exposure position Ph to the transfer position Pt during image formation, and η satisfies −π≤η≤π. In this case, when u is an arbitrary integer (integral number) and T is a cyclic period of one-full circumference of the motor 20, a relationship between the times to and tb is represented by the following formula 4.

$$tb = ta + uT + \frac{\eta}{2\pi}T \quad \text{(formula 4)}$$

Further, T=2π/ω holds, and therefore, the formula 4 can be rewritten as the following formula 5.

$$ta = tb - \frac{2\pi u}{\omega} - \frac{\eta}{\omega} \quad \text{(formula 5)}$$

Here, when the formulas 1, 2 and 5 are substituted into the formula 3, the pitch fluctuation V is represented by the following formula 6.

$$V=A\sin(\omega tb-\eta)+B\sin(\omega tb-\eta+\theta)-B\sin(\omega tb+\theta)+B\sin(\omega tb+\theta+\Phi) \quad \text{(formula 6)}$$

Here, in the formula 6, in the case where tb+θ/ω is a time tc, the pitch fluctuation is represented by the following formula 7.

$$V=A\sin(\omega tc-\eta-\theta)+B\sin(\omega tc-\eta)-B\sin\omega tc+B\sin(\omega tc+\Phi) \quad \text{(formula 7)}$$

Here, as described above, phases of wave forms of the speed fluctuations of the stepped gears 22 and 25 due to the rotation non-uniformity of the motor 20 itself are the phase. Accordingly, for simplification of the following calculation, even when the rotation non-uniformity of the motor 20 itself is regarded as zero, generality of discussion is not lost. Therefore, in the following calculation, a relationship between the engaging phase difference Φ and the rotation amount 11 for reducing the pitch fluctuation V is acquired by using A=0 and B=1. When A=0 and B=1 are substituted into the formula 7, the following formula 8 is acquired.

$$V=\sin(\omega tc-\eta)-\sin\omega tc+\sin(\omega tc+\Phi) \quad \text{(formula 8)}$$

Further, when composition of a trigonometric function is carried out for a second term and a third term on the right side in the formula 8, the following formula 9 is acquired.

$$V = \sin(\omega tc-\eta)+\sqrt{2-2\cos\Phi}\,\sin(\omega tc+\beta) \quad \text{(formula 9)}$$

$$\beta = \tan^{-1}\left(\frac{\sin\Phi}{-1+\cos\Phi}\right)+\pi$$

Next, when composition of a trigonometric function is carried out for the right side of V in the formula 9, the following formula 10 is acquired by using a phase γ of the composition wave.

$$V = \sqrt{2-2\cos\Phi+1+2\sqrt{2-2\cos\Phi}\cos(-\beta-\eta)}\,\sin(\omega tc+\gamma) \quad \text{(formula 10)}$$

Next, β is calculated. The following formula 11 holds, and therefore, β=(Φ+π)/2 holds.

$$\tan\left(\frac{\pi-\Phi}{2}\right)=\frac{\sin\Phi}{1-\cos\Phi} \quad \text{(formula 11)}$$

Here, the case where an amplitude of the pitch fluctuation V becomes a minimum for the engaging phase difference Φ set in advance is the case where cos (−β−η)=−1 holds from the formula 10. That is, −β−η=π holds, and therefore, when the above-acquired β is substituted in the formula 11, the following formula 12 is acquired.

$$-\frac{(\Phi+\pi)}{2}-\eta=\pi \quad \text{(formula 12)}$$

$$\eta=\frac{(\pi-\Phi)}{2}$$

From the formula 12, a rotation amount η in which the amplitude of the pitch fluctuation V becomes the minimum for the engaging phase difference Φ set in advance was acquired. This result is easily understood when consideration is made as described below. When the formula 12 is substituted into the formula 8, the following formula 13 holds.

$$V=\sin\left(\omega tc+\frac{(\Phi+\pi)}{2}\right)+\sin(\omega tc+\pi)+\sin(\omega tc+\Phi) \quad \text{(formula 13)}$$

In the formula 13, an average of π which is a phase of the second term of the right side and Φ which is a phase of the third term of the right side is (Φ+π)/2. Further, a phase: −η=(Φ−π)/2 of the first term of the right side is deviated in phase from the average of π and Φ by π (180 degrees) (−η=(Φ−π)/2−π). That is, it is understood that η is determined so that the amplitude becomes smallest for the phase π and the engaging phase difference Φ which are set in advance.

Next, the engaging phase difference Φ at which the amplitude of the pitch fluctuation V becomes the minimum, and the amplitude of the pitch fluctuation V at that time will be calculated. The amplitude of the pitch fluctuation V calculated in the formula 10 is referred to as Va, and when cos(−β−η)=−1 is substituted in the formula 10, the following formula 14 holds.

$$Va=\sqrt{2-2\cos\Phi+1-2\sqrt{2-2\cos\Phi}} \quad \text{(formula 14)}$$

Further, in the formula 14, when $$\sqrt{2-2\cos\Phi}=x$$

holds, the following formula 15 is acquired.

$$Va=\sqrt{x^2-2x+1}=\sqrt{(x-1)^2} \quad \text{(formula 15)}$$

From the formula 15, the amplitude Va becomes 0 when x=1 holds, and thus becomes a minimum.

$$\sqrt{2-2\cos\Phi}=1$$

Further, when this formula is solved with respect to cos Φ, cos Φ=½ holds. Accordingly, 1=π/3, 5π/3 holds.

From the formula 12, when 1=π/3, η=π/3 holds, and when Φ=5π/3, η=−π/3 holds. In this case (x=1), the amplitude Va of the pitch fluctuation V is calculated as shown in the following formula 16 and becomes zero. That is, the influences of the run-out of the shaft 20*a* of the motor 20 and the eccentricity of the pinion gear 21 are completely absorbed.

$$Va=\sqrt{(1-1)^2}=0 \quad \text{(formula 16)}$$

This result is easily understood when consideration is made in the following manner. When Φ=π/3 and η=π/3 are substituted into the formula 8, the following formula 17 is acquired.

$$V=\sin\left(\omega tc-\frac{\pi}{3}\right)+\sin(\omega tc+\pi)+\sin\left(\omega tc+\frac{\pi}{3}\right) \quad \text{(formula 17)}$$

From the formula 17, it is understood that the pitch fluctuation V is the sum of three sine waves in which phases thereof are deviated from each other by 2π/3 (120 degrees). That is, by setting the engaging phase difference Φ and the rotation amount η so that the phases of the three sine waves (Vd (ta), −Vd (tb), Vh (tb)) are deviated from each other by 2π/3 (120 degrees).

Next, the rotation amount η in which the amplitude of the pitch fluctuation V becomes the same as an amplitude in the case where the motor 20 rotates an integral number of times when the photosensitive drum 1 rotates from the exposure position Ph to the transfer position Pt is calculated. Incidentally, although η=0 holds in the case where the motor 20 rotates the integral number of times when the photosensitive drum 1 rotates from the exposure position Ph to the transfer position Pt, in the following, a solution in the case where η≠0 is acquired.

First, when η=0 is substituted into the formula 8, V=sin (ωtc+Φ) holds, so that the amplitude is 1. Accordingly, in the formula 8, the amplitude also becomes 1 when a relationship of the following formula 18 holds.

$$\sin(\omega tc-\eta)=-\sin(\omega tc+\Phi) \quad \text{(formula 18)}$$

In the formula 18, the phase is deviated between the left side and the right side by π (180 degrees), and therefore, η=π×Φ holds. Accordingly, in the case of η=0, π−Φ, the amplitude of the pitch fluctuation V becomes the same as the amplitude in the case where the motor 20 rotates the integral number of times when the photosensitive drum 1 rotates from the exposure position Ph to the transfer position Pt.

From the above, in the case where the rotation amount η satisfies the following condition 1 or the following condition 2, the pitch fluctuation V of the toner image on the sheet S becomes smaller than a pitch fluctuation in the case where the motor 20 rotates the integral number of times when the photosensitive drum 1 rotates from the exposure position Ph to the transfer position Pt. That is, by setting the rotation amount 11 and the engaging phase difference Φ so as to satisfy the condition 1 or the condition 2, compared with the case where the motor 20 rotates the integral number of times when the photosensitive drum 1 rotates from the exposure position Ph to the transfer position Pt, the influence of the rotation non-uniformity of the motor 20 on the image on the sheet S can be reduced.

$$0<\eta<\pi-\Phi \quad \text{(condition 1)}$$

$$\pi-\Phi<\eta<0 \quad \text{(condition 2)}$$

Here, it is preferable that by setting the rotation amount η and the engaging phase difference Φ so as to satisfy η=(π−

$\Phi)/2$ shown in the formula 12, the amplitude of the pitch fluctuation V becomes a minimum for the engaging phase difference $\Phi$ set in advance. Further, in the case where setting is made so that $\eta=\pi/3$ and $\Phi=\pi/3$ hold or $\eta=\pi/3$ and $\Phi=5\pi/3$ hold, the influences of the run-out of the shaft 20*a* of the motor 20 and the eccentricity of the pinion gear 21 are completely absorbed, and therefore, such a case is further preferable.

FIG. 4 is a graph showing a relationship between the rotation amount $\eta$ and the pitch fluctuation V in the case where $\Phi$ is $\Phi1=4\pi/3$ and the case where $\Phi$ is $\Phi2=5\pi/3$. As shown in FIG. 4, it is understood that the amplitude of the pitch fluctuation V becomes a minimum when $\eta=(\pi-\Phi)/2$ holds, and in the case where $\eta=\pi-\Phi$ holds, the amplitude becomes the same as the amplitude at the time when $\eta=0$. Further, it is understood that in the case of $\Phi2=5\pi/3$, at $\eta=-\pi/3$, the amplitude of the pitch fluctuation V becomes zero.

However, for convenience of arrangement, it is difficult to set $\Phi$ at $\Phi=\pi/3$, $5\pi/3$, i.e., $\pm\pi/3$ ($\pm60$ degrees) in some instances. Even in this case, when $\Phi$ can be set in a range of $-3\pi/4$ ($=5\pi/4$)$<\Phi<3\pi/4$, reduction of the pitch fluctuation V can be realized. For example, in the case where $\Phi$ is set at $\Phi=3\pi/4$ or $\Phi=5\pi/4$, an effect of reducing the pitch fluctuation V by 15% is achieved.

In this embodiment, as described above, a reduction ratio of the gear train from the motor 20 to the photosensitive drum 1 is 0.0904, and the angle $\Psi$ is set at $0.889\pi$ (160 degrees). Accordingly, the rotation amount of the motor 20 when the photosensitive drum 1 rotates from the exposure position Ph to the transfer position Pt during image formation is 4.915 times ($=1/0.0904\times160/360$) the one-full circumference of the motor 20. For this reason, $\eta=(4.915-5)\times2\times\pi=-0.170\pi$ ($-30.5$ degrees)$\approx-\pi/6$ ($-30$ degrees).

Further, in this embodiment, as described above, $\Phi$ is set at $\Phi=4\pi/3$ (240 degrees). Accordingly, a relationship of $\pi-\Phi<\eta<0$ holds, so that the pitch fluctuation V is reduced. Further, $\eta\approx(\pi-\Phi)/2$ holds, and therefore $\eta$ for the engaging phase difference $\Phi$ ($=4\pi/3$) is set at an optimum value, so that the pitch fluctuation V is minimized. Further, the engaging phase difference $\Phi$ ($=4\pi/3=240$ degrees$=-120$ degrees) falls in a range of $-3\pi/4<\Phi<3\pi/4$, and therefore, the effect of reducing the pitch fluctuation V is sufficiently obtained.

Further, in this embodiment, the large gear portion 22*a* of the stepped gear 22 and the large gear portion 25*a* of the stepped gear 25 engage with each other substantially at the same position relative to the pinion gear 21 with respect to the thrust direction. Accordingly, influence of the run-out of the shaft 20*a* of the motor 20 can be made the same between the photosensitive drum 1, and the registration roller pair 13 and the pressing roller 6*a* which are used for feeding the sheet S, so that the reduction in pitch fluctuation V can be effectively carried out.

Incidentally, in the above, although description was made that the sheet S is fed (conveyed) by the registration roller pair 13 and the pressing roller 6*a* at the transfer position Pt of the photosensitive drum 1, a motor for feeding the sheet S is different depending on a size or the like of the sheet S. For example, in the case where the size of the sheet S is large, a constitution in which at the transfer position Pt of the photosensitive drum 1, the sheet S is fed (conveyed) by the conveying roller pair 12 in addition to the registration roller pair 13 and the pressing roller 6*a* would be also considered, and in this case, the conveying roller pair 12 also constitutes the moving motor for moving the developing image receiving member. Here, at the transfer position Pt of the photosensitive drum 1, a constitution in which the sheet S is fed on an upstream side and a downstream side with respect to a feeding direction of the sheet S is employed, and thus accuracy of a feeding speed of the sheet S at the transfer position Pt of the photosensitive drum 1 is enhanced, and therefore, it is possible to form an image with a further high quality.

Incidentally, in the above-described calculation, although calculation is made in the formula 7 by using simplified values of A=0 and B=1, the pitch fluctuation V is calculated from the formula 10 in accordance with the following formula 19.

$$V = A\sin(\omega tc - \eta - \theta) + B\sqrt{2 - 2\cos\Phi + 1 + 2\sqrt{2 - 2\cos\Phi}\cos(-\beta - \eta)}\sin(\omega tc + \gamma) \quad \text{(formula 19)}$$

In the formula 19, 0 represents a phase difference between the run-out of the shaft 20*a* for rotation non-uniformity of the motor 20 itself and a composite wave of eccentricity of the pinion gear 21. The phase difference $\theta$ varies in value between individual image forming apparatuses 100 since $\theta$ changes due to manufacturing variations of the motor 20 and the pinion gear 21, a mounting phase of the pinion gear 21 on the shaft 20*a* of the motor 20, and the like. Accordingly, it is desirable that $\theta$ is calculated on assumption of a worst phase. In the pitch fluctuation V of the formula 19, in the case where the phases of the sine waves of the first term and the second term of the right side are the same, i.e., in the case where $-\eta-\theta=\gamma$ holds, $\theta$ becomes worst. When $-\eta-\theta=\gamma$ is substituted into the formula 19, the following formula 20 is acquired.

$$V = \left\{A + B\sqrt{2 - 2\cos\Phi + 1 + 2\sqrt{2 - 2\cos\Phi}\cos(-\beta - \eta)}\right\}\sin(\omega tc + \gamma) \quad \text{(formula 20)}$$

An amplitude of the formula 20 is obtained by multiplying the amplitude of the formula 10 by B and then by subtracting A from a resultant value. Accordingly, contents in which the formula 10 is calculated and discussed hold as they are.

Second Embodiment

Next, a second embodiment of an image forming apparatus according to the present invention will be described using the drawings. As regards portions overlapping with those of the first embodiment, description thereof will be omitted by adding thereto the same reference numerals or symbols.

An image forming apparatus 100 according to this embodiment is an image forming apparatus of an intermediary tandem type in which as developers, toners (toner images) of four colors of yellow Y, magenta M, cyan C, and black K are transferred onto an intermediary transfer belt 96 and thereafter an image is formed on the sheet S by transferring the toner images onto the sheet S. Incidentally, in the following description, although suffixes Y, M, C and K are added to motors for the respective color toners, constitutions and operations of the motors are substantially the same except that the colors of the toners are different from each other, and therefore, the suffixes will be appropriately omitted except for the case where distinction thereof is required.

FIG. 5 is a schematic sectional view of the image forming apparatus 100 according to this embodiment. As shown in FIG. 5, the image forming apparatus 100 includes an image forming portion 45 for forming the images (toner images) on the sheet S. The image forming portion 45 includes photosensitive drums 1 (1Y, 1M, 1C, 1K), a laser scanner unit 3, charging rollers 2 (2Y, 2M, 2C, 2K), and developing rollers 4 (4Y, 4M, 4C, 4K).

Further, the image forming portion 45 includes primary transfer rollers 55 (55Y, 55M, 55C, 55K), a secondary transfer roller 91, a secondary transfer opposite roller 92, a driving roller 93, and the intermediary transfer belt 96. The intermediary transfer belt 96 (intermediary transfer member, developing image receiving member) is an endless cylindrical belt stretched around the secondary transfer opposite roller 92 and the driving roller 93, and is circulated and moved by rotation of the driving roller 93.

Next, an image forming operation will be described. First, when an unshown controller receives an image forming job signal, a sheet S stacked and accommodated in a sheet cassette 9 is fed to a registration roller pair 13 by a pick-up roller 10 and a feeding roller pair 11. The registration roller pair 13 feeds the sheet S, at a predetermined timing, to a secondary transfer portion formed by the secondary transfer roller 91 and the secondary transfer opposite roller 92.

On the other hand, in the image forming portion 45, first, the surface of the photosensitive drum 1Y is electrically charged by the charging roller 2Y. Thereafter, the laser scanner unit 3 causes the surface of the photosensitive drum 1 to be irradiated with laser light L depending on image data inputted from an unshown external device. By this, on the surface of the photosensitive drum 1, an electrostatic latent image depending on the image data is formed.

Next, yellow toner is supplied to the electrostatic latent image formed on the surface of the photosensitive drum 1Y, so that a yellow toner image (developer image) is formed on the surface of the photosensitive drum 1Y. The toner image formed on the surface of the photosensitive drum 1Y is primary-transferred onto the intermediary transfer belt 96 by applying a bias to the primary transfer roller 55Y.

By a similar process, the toner images of magenta, cyan, and black are formed on the photosensitive drums 1M, 1C, and 1K, respectively. Then, by applying biases to the primary transfer rollers 55M, 55C, and 55K, these toner images are superposedly transferred onto the yellow toner image on the intermediary transfer belt 96. By this, a full-color toner image is formed on the surface of the intermediary transfer belt 96.

When the intermediary transfer belt 96 carrying the full-color toner image moves, the toner image is sent to the secondary transfer portion. Then, in the secondary transfer portion, the toner image on the intermediary transfer belt 96 is transferred onto the sheet S by applying a bias to the secondary transfer roller 91.

Then, the sheet S on which the toner image is formed is fed to a fixing device 6. Then, the sheet S is subjected to a heating and pressing process in a fixing nip portion formed by a pressing roller 6*a* and a heating roller 6*b* which are included in the influence device 6, whereby the toner image on the sheet S is fixed on the sheet S. Therefore, the sheet S on which the toner image is fixed is discharged to a discharge portion 8 by a discharging roller pair 7.

Here, in this embodiment, different from the first embodiment, the toner image is transferred from the photosensitive drum 1 onto the intermediary transfer belt 96 by the primary transfer roller 55. Accordingly, the transfer position Pt in this embodiment is a position, with respect to the rotational direction of the photosensitive drum 1, where the toner image is transferred onto the intermediary transfer belt 96 which is the developing image receiving member by the primary transfer roller 55 which is the transfer member. Further, in this embodiment, an angle of rotation Ψ from the exposure position Ph to the transfer position Pt with respect to the rotational direction of the photosensitive drum 1 during image formation is set at 0.944π [rad] (170 degrees) in this embodiment.

Further, when the toner image is transferred from the photosensitive drum 1 onto the intermediary transfer belt 96 by the primary transfer roller 55, the intermediary transfer belt 96 is moved by the driving roller 93. That is, the driving roller 93 is a moving member for moving the intermediary transfer belt 96 when the toner image is transferred from the photosensitive drum 1 onto the intermediary transfer belt 96 which is the developing image receiving member. Further, a moving speed of the intermediary transfer belt 96 is determined by the driving roller 93.

Next, a structure of a driving unit 50 in this embodiment will be described. In this embodiment, the driving unit 50 drives the photosensitive drums 1Y, 1M, 1C and 1K and the driving roller 93 by a single motor 20.

FIG. 6 is a schematic view of the driving unit 50. As shown in FIG. 6, the driving unit 50 includes, as a gear train (first driving transmitting portion) for driving the photosensitive drums 1Y to 1K, a pinion gear 21 (first gear) mounted on a shaft 20*a* of the motor 20, idler gears 82*a* to 82*c* stepped gears 83*a* and 83*b*, and drum driving gears 84*a* to 84*d*.

The idler gear 82*a* (second gear) engages with the pinion gear 21 (first gear), and the idler gears 82*b* and 82*c* engage with the idler gear 82*a*. The stepped gear 83*a* includes a large gear portion 83*a*1 engaging with the idler gear 82*b* and a small gear portion 83*a*2 engaging with the drum driving gears 84*a* and 84*b*. The stepped gear 83*b* includes a large gear portion 83*b*1 engaging with the idler gear 82*c* and a small gear portion 83*b*2 engaging with the drum driving gears 84*c* and 84*d*. The drum driving gears 84*a* to 84*d* are gears mounted integrally with the photosensitive drums 1Y, 1M, 1C and 1K, respectively.

When the motor 20 is driven, the pinion gear 21 is rotated, so that a pinion gear force is transmitted to the drum driving gears 84*a* to 84*d* via the idler gears 82*a* to 82*c* and the stepped gears 83*a* and 83*b*. By this, the photosensitive drums 1Y to 1K are rotated integrally with the drum driving gears 84*a* to 84*d*, respectively.

In this embodiment, the number of teeth of the driving is set at 12 teeth, the number of teeth of each of the large gear portions 83*a*1 and 83*b*1 of the stepped gears 83*a* and 83*b* is set at 59 teeth, the number of teeth of each of the small gear portions 83*a*2 and 83*b*1 of the stepped gears 83*a*2 and 83*b*2 is set at 40 teeth, and the number of teeth of the drum driving gears 84*a* to 84*d* is set at 89 teeth. From a relationship of these numbers of teeth, a (speed) reduction ratio of a gear train from the motor 20 to each of the photosensitive drums 1Y to 1K is 0.0914 $(=(12/59)\times(40/89))$.

Further, the driving unit 50 includes the pinion gear 21, idler gears 82*d* to 82*i*, and a driving roller gear 85, as a gear train (second driving transmitting portion) for driving the driving roller 93. The idler gear 82*d* (third gear) engages with the pinion gear 21. The idler gears 82*e* to 82*i* form a gear train between themselves and the idler gear 82*d* and the driving roller gear 85. The driving roller gear 85 is a gear mounted integrally with the driving roller 93. When the motor 20 is driven, the pinion gear 21 is rotated, and the driving force is transmitted to the driving roller gear 85 via the idler gears 82*d* to 82*i*. By this, the driving roller 93 integrally rotates the driving roller gear 85.

Here, the idler gear 82*d* is the same as the idler gear 82*a* in number of teeth and module, and engages with the pinion gear 21 at the substantially same position with respect to the thrust direction. The substantially same position referred to in this embodiment includes the case where the positions of the idler gear 82*a* and the idler gear 82*d* with respect to the thrust direction are completely the same and the case where the positions of the idler gear 82*a* and the idler gear 82*d* with respect to the thrust direction are deviated within a tolerance range.

Further, an engaging phase difference Φ in this embodiment is an angle formed by a rectilinear line connecting a gear center 82*a*1 of the idler gear 82*a* and a gear center 81*c* of the pinion gear 21 and a rectilinear line connecting a gear center 82*d*1 of the idler gear 82*d* and the gear center 81*c* of the pinion gear 21, and is set at $\Phi=\pi/3$ [rad] (60 degrees). A positive direction of the engaging phase difference Φ is a direction opposite to the arrow roller direction which is a rotational direction of the pinion gear 21 during image formation.

In this embodiment, as described above, a reduction ratio of the gear train from the motor 20 to the photosensitive drum 1 is 0.0914, and the angle is set at $0.944\pi$ (170 degrees). Accordingly, the rotation amount of the motor 20 when the photosensitive drum 1 rotates from the exposure position Ph to the transfer position Pt during image formation is 5.166 times ($=1/0.0914\times170/360$) the one-full circumference of the motor 20. For this reason, $\eta=(5.166-5)\times2\times\pi=0.332\pi$ (59.7 degrees)$\approx\pi/3$ (60 degrees).

Further, in this embodiment, as described above, Φ is set at $\Phi=\pi/3$ (60 degrees). Accordingly, a relationship of $0<\eta<\pi-\Phi$ holds, so that the pitch fluctuation V is reduced. Incidentally, the pitch fluctuation V in this embodiment is a pitch fluctuation V of the image on the intermediary transfer belt 96 as the developing image receiving member onto which the toner image is transferred from the photosensitive drum 1. Further, $\eta\approx(\pi-\Phi)/2$ holds, and therefore η for the engaging phase difference Φ ($=\pi/3$) is set at an optimum value, so that the pitch fluctuation V is minimized. Further, the engaging phase difference Φ is $\pi/3$ (60 degrees), so that the influences of the run-out of the shaft 20*a* of the motor 20 and a component of eccentricity of the pinion gear 21 are completely absorbed, and therefore, the pitch fluctuation V is sufficiently reduced.

Incidentally, in this embodiment, although the image forming apparatus 100 of an intermediary transfer type was described, the present invention is not limited to this. That is, as shown in FIG. 7, the present invention is also applicable to an image forming apparatus 100 of a direct transfer type in which an image is formed on the sheet S by directly transferring superposedly toner images from photosensitive drums 1Y, 1M, 1C and 1K onto the sheet S, conveyed by a conveying belt 94, by transfer rollers 5Y, 5M, 5C and 5K, respectively. In this constitution, a developing image receiving member onto which the toner images are transferred from the photosensitive drum 1Y, 1M, 1C and 1K is the sheet S, and a moving motor for moving the sheet S is the conveying belt 94. Further, the conveying belt 94 is stretched by a driving roller 95 and a stretching roller 98, and is circulated and moved by rotation of the driving roller 95.

According to the present invention, in the image forming apparatus in which the moving motor for moving the photosensitive member and the developing image receiving member is driven by the single motor, the adverse influence on the image caused due to the rotation non-uniformity of the motor can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-186758 filed on Nov. 9, 2020, which is hereby incorporated by reference herein in its entirety.

What is claimed is:

1. An image forming apparatus comprising:

a photosensitive member;

a charging member configured to electrically charge said photosensitive member;

an exposure member configured to form an electrostatic latent image by irradiating a surface of said photosensitive member with light;

a developing member configured to form a developer image by supplying a developer to the electrostatic latent image;

a transfer member configured to transfer the developer image onto a sheet;

a roller configured to move the sheet when the developer image is transferred from said photosensitive member onto the sheet;

a motor including a shaft provided with a first gear;

a first drive transmitting portion configured to transmit a driving force of said motor to said photosensitive member and including a second gear engaging with said first gear; and a second drive transmitting portion configured to transmit the driving force of said motor to said roller and including a third gear engaging with said first gear, wherein in a case that a position where said photosensitive member is irradiated with the light by said exposure member with respect to a rotational direction of said photosensitive member is an exposure position, a position where the developer image is transferred onto the sheet by said transfer member with respect to the rotational direction is a transfer position, and an angle formed by a line connecting a rotation center of said first gear and a rotation center of said second gear and a line connecting the rotation center of said first gear and a rotation center of said third gear is Φ [rad] in which a direction opposite to a rotational direction of said first gear during image formation is a positive direction of Φ, a rotation amount of said motor when said photosensitive member rotates from the exposure position to the transfer position during the image formation is:

$$2\pi n+\eta\text{[rad]},$$

where n is a natural number, and η is an increased rotation amount [rad] of said motor, and wherein the following relationship is satisfied:

$$0<\eta<\pi-\Phi.$$

2. An image forming apparatus according to claim 1, wherein $\eta=(\pi-\Phi)/2$ holds.

3. An image forming apparatus according to claim 1, wherein the following relationship is satisfied:

$$-3\pi/4<\Phi<3\pi/4.$$

4. An image forming apparatus according to claim 3, wherein $\Phi=\pm\pi/3$ holds.

5. An image forming apparatus according to claim 1, wherein with respect to a thrust direction, a position where said second gear engages with said first gear and a position where said third gear engages with said first gear are the same.

6. An image forming apparatus comprising:

a photosensitive member;

a charging member configured to electrically charge said photosensitive member;

an exposure member configured to form an electrostatic latent image by irradiating a surface of said photosensitive member with light;

a developing member configured to form a developer image by supplying a developer to the electrostatic latent image;

a transfer member configured to transfer the developer image onto a sheet;

a roller configured to move the sheet when the developer image is transferred from said photosensitive member onto the sheet;

a motor including a shaft provided with a first gear;

a first drive transmitting portion configured to transmit a driving force of said motor to said photosensitive member and including a second gear engaging with said first gear; and a second drive transmitting portion configured to transmit the driving force of said motor to said roller and including a third gear engaging with said first gear, wherein in a case that a position where said photosensitive member is irradiated with the light by said exposure member with respect to a rotational direction of said photosensitive member is an exposure position, a position where the developer image is transferred onto the sheet by said transfer member with respect to the rotational direction is a transfer position, and an angle formed by a line connecting a rotation center of said first gear and a rotation center of said second gear and a line connecting the rotation center of said first gear and a rotation center of said third gear is $\Phi$ [rad] in which a direction opposite to a rotational direction of said first gear during image formation is a positive direction of $\Phi$, a rotation amount of said motor when said photosensitive member rotates from the exposure position to the transfer position during the image formation is:

$$2\pi n+\eta \text{[rad]},$$

where n is a natural number, and $\eta$ is an increased rotation amount [rad] of said motor, and wherein the following relationship is satisfied:

$$\pi-\Phi<\eta<0.$$

7. An image forming apparatus according to claim 6, wherein $\eta=(\pi-\Phi)/2$ holds.

8. An image forming apparatus according to claim 6, wherein the following relationship is satisfied:

$$-3\pi/4<\Phi<3\pi/4.$$

9. An image forming apparatus according to claim 8, wherein $\Phi=\pm\pi/3$ holds.

10. An image forming apparatus according to claim 6, wherein with respect to a thrust direction, a position where said second gear engages with said first gear and a position where said third gear engages with said first gear are the same.

* * * * *